United States Patent [19]

Fletcher et al.

[11] 4,088,926

[45] May 9, 1978

[54] PLASMA CLEANING DEVICE

[76] Inventors: James C. Fletcher, administrator of the National Aeronautics and Space Administration, with respect to an invention of Roger L. Shannon, Federal Way; Roger B. Gillette, Auburn, both of Wash.

[21] Appl. No.: 684,807

[22] Filed: May 10, 1976

[51] Int. Cl.[2] ..... H01J 15/02

[52] U.S. Cl. ..... 315/111.2; 29/81 C; 313/231.3

[58] Field of Search ..... 315/111, 111.2; 313/231, 231.3; 29/81 C

[56] References Cited

U.S. PATENT DOCUMENTS 3,209,189 9/1965 Patrick ..... 315/111.2 X 3,437,864 4/1969 Kofoid et al. ..... 313/231.3 X

*Primary Examiner*—Eugene R. LaRoche

*Attorney, Agent, or Firm*—George J. Porter; John R. Manning; L. D. Wofford, Jr.

[57] ABSTRACT

Apparatus for cleaning contaminated surfaces such as hydro-carbon contaminant films in high vacuum environments including a plasma discharge housing for allowing a plasma to be generated in an environment having a higher pressure than the surface which is to be cleaned. A ground electrode and a radio frequency electrode partially surround a quartz plasma tube, for the introduction of an ionizable gas therein. These electrodes ionize the gas and help generate the plasma. This plasma flows through a non-constrictive aperture, through the plasma discharge housing and then on to the contaminated surface.

7 Claims, 2 Drawing Figures

PLASMA CLEANING DEVICE

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

FIELD OF THE INVENTION

The present invention relates to a cleaning device utilizing a plasma and has particular application in cleaning contaminated surfaces contained in a high vacuum (low pressure) environment, such as optical surfaces in space, thereby restoring the reflectance of both radiation-damaged white paint and organic-film-contaminated telescope mirror surfaces.

BACKGROUND OF THE INVENTION

Existing plasma cleaning devices depend primarily on the production of a plasma in a gas environment surrounding the contaminated surface. The contaminant is then removed as the active plasma species collide with the surface. At low gas pressures (less than about $10^{-5}$ torr), either the gas density is too low for a plasma discharge to be established, or the plasma density is too low to produce significant contaminant cleaning. Consequently, existing plasma cleaning devices are not operable at high vacuum conditions, since these devices must produce the plasma in the high vacuum environment. In the context of this application, the terms "high vacuum environment" and "low pressure environment" are interchangeable.

A solution to this problem is to generate the plasma in a confined higher pressure region and allow it to flow into the high vacuum area. Prior attempts to implement this solution utilized a flow restriction to separate the high and low pressure regions. These attempts failed because the active plasma species were destroyed during passage through the flow restriction. The present invention implements a solution to this problem by generating the plasma at the point immediately before the confined gas enters the high vacuum region.

U.S. Pat. No. 3,264,508 issued to Lai et al shows a plasma torch used for cutting, welding or for flame spraying tasks involving fine or delicate work which generates a hot plasma in a manner similar to the present invention. It is significant to note that all these operations are performed in regions of normal atmospheric pressures and not in a high vacuum environment. The torch contains a source of highly ionizable gas which is passed through a tube surrounded by a wire coil connected to a radio frequency generator. When the power is applied to this r.f. generator, the gas within the region of the coil ionizes and is then passed through a constrictive opening before leaving the tube.

Other representative patents relating to plasma generators are U.S. Pat. No. 3,139,509 issued to Browning; U.S. Pat. No. 3,192,427 issued to Sugawara et al; and U.S. Pat. No. 3,903,891 issued to Brayshaw.

SUMMARY OF THE INVENTION

It is the primary object of the present invention to overcome the defects of the prior art by producing a plasma cleaning device capable of adequately cleaning a contaminated surface present in a high vacuum region. The problems associated with producing the plasma in the environment directly surrounding the contaminated surface have been eliminated by generating the plasma in a higher pressure environment than the contaminated surface and then ejecting the plasma into the high vacuum region through a non-constrictive aperture. Additionally, the present invention utilizes cold, low intensity plasma ensuring that the surface being cleaned is not damaged.

Very low gas flow rates are needed to meet the high vacuum requirements for vacuum chamber applications because of pumping limitations. Low flow rates are also called for in space applications to conserve gas. The high vacuum condition requires either the plasma discharge to occur at low pressure or to have a flow restriction between the discharge region and the high vacuum region. The earlier development attempts using the flow restriction technique have been found to be inadequate. The plasma was destroyed in passage through the the restriction by collisions with the wall. This plasma attenuation depends on the size of the restriction and the mean free path of the plasma species. As the mean free path length approaches the diameter of the restriction, most of the plasma particles will collide with the wall before passing through the restriction. The importance of pressure in this process is seen from the following order of magnitude table of mean free path length versus pressure.

| PRESSURE (TORR) | MEAN FREE PATH (CM) |
|---|---|
| 1000 | $10^{-6}$ |
| 100 | $10^{-5}$ |
| 10 | $10^{-4}$ |
| 1 | $10^{-3}$ |
| $10^{-1}$ | $10^{-2}$ |
| $10^{-2}$ | $10^{-1}$ |
| $10^{-3}$ | 1 |
| $10^{-4}$ | 10 |
| $10^{-5}$ | $10^{2}$ |

At low gas flow rates the pressure at the downstream end of the restriction approaches that of the surrounding vacuum and the gas molecules have many wall collisions before entering the vacuum. The present device generates the plasma at relatively low pressure by using an axial r.f. field so as to reduce wall effects which limit the establishment of a discharge. By generating this plasma near the downstream end of the plasma tube, a significant portion of the plasma species enter the vacuum without suffering wall collisions.

According to the present invention, high vacuum cleansing can be accomplished by a plasma cleaning device containing a plasma discharge housing separating a plasma generating mechanism contained in the interior of the housing from the high vacuum enviornment. The plasma generating mechanism is constituted by a plasma tube connected to a source of ionizable gas. A pair of electrodes partially surrounding the tube is connected to a r.f. generator creating an axial r.f. field in the region between the electrodes and thereby generating a plasma therebetween. This plasma then flows through a non-constrictive aperture into the high vacuum region and then onto the contaminated surface. In this manner, no contact is ever made between the electrodes and the plasma thereby preventing contamination of the contaminated surface.

BRIEF DESCRIPTION OF THE DRAWING

The above and additional objects and advantages inherent in the present invention will become more apparent by reference to the description of an illustrated embodiment of the drawing thereof in which.

DETAILED DESCRIPTION OF THE PREFERRED EMBODIMENT

Figure 1:
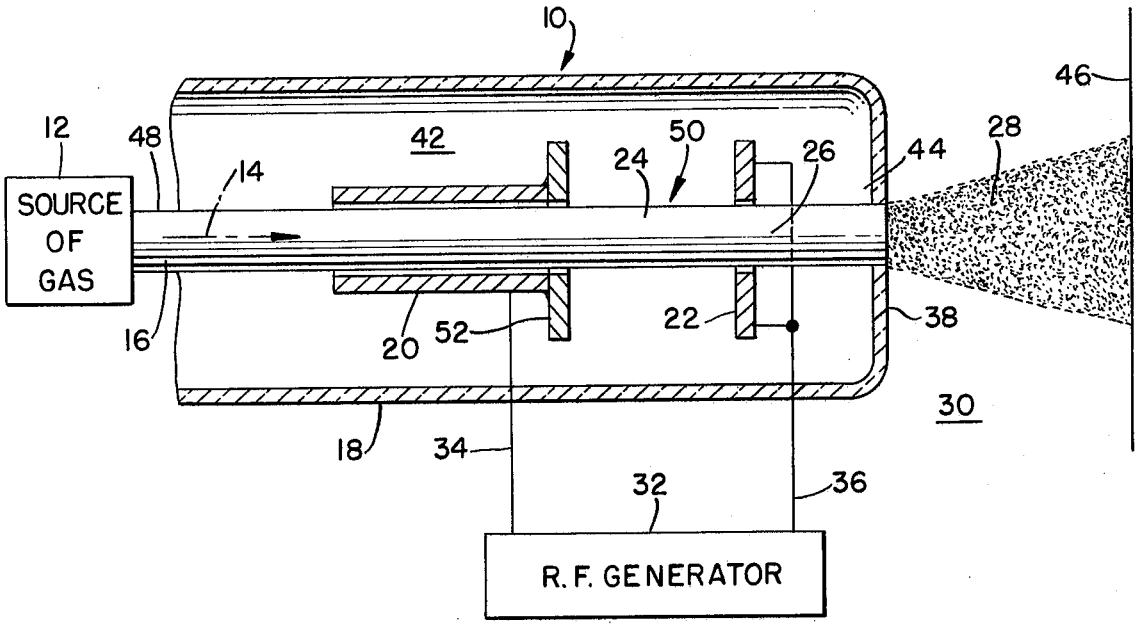
FIG. 1 is a partially sectional view of an embodiment of the plasma cleaning device according to the present invention.
Figure 2:
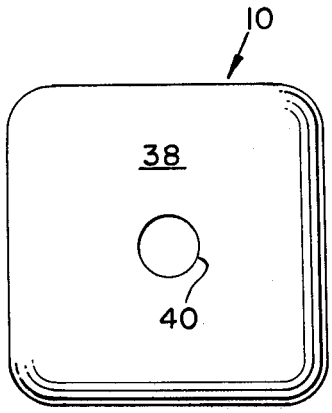
FIG. 2 is an end view of the present invention showing the non-constrictive aperture.

The plasma discharge device 10 illustrated by FIGS. 1 and 2 comprises a generally cylindrical and substantially hollow conductive shield or tube 18 constituted of a high temperature resistant dielectric material such as quartz, effectively separating the interior of the quartz tube 18 from the high vacuum environment 30 containing a contaminated surface 46 which must be cleansed.

The interior of the shield 18 contains a substantially cylindrical inner quartz conduit or tube 16 having an admitting end section 48 in direct communication with a source 12 of ionizable gas such as argon or oxygen, an emitting section 50 and a nozzle portion 44. The tube 16 is partially encircled by a cylindrically-shaped ground electrode lead 20, a ring-shaped upstream ground electrode 52 and a downstream ring-shaped radio frequency electrode 22 connected to a radio frequency generator 32 by means of electrical leads 34 and 36, respectively, said leads being insulated by lengths of quartz tubing while within the tube assembly. The leads are connected to the plasma tube by standard coaxial cables. The upstream electrode 52 is brazed to lead 20 which also acts as a shield for the upstream gas. Both electrodes 22 and 52, as well as lead 20 can be constituted of a copper material. Since tuning the r.f. power supply for proper operation may require observation of the discharge, light pipes (not shown) can be included for transmitting light from the discharge end of the device to the outside of the plasma tube assembly.

The end wall 38 of the plasma cleaning device 10 contains an aperture 40 which has the same or greater cross-sectional area and diameter as the inner tube 16 in the section between the ground electrode 20 and the end wall 38, including nozzle portion 44. This nozzle portion 44 of the tube 16 and end wall 38 is a single integral unit, the nozzle portion 44 terminating at aperture 40 thereby allowing the plasma generated therein to be directed into the high vacuum region 30 containing the contaminated surface 46.

In operation, the gas 14 flows through the inner tube 16 toward the nozzle area 44. When power is applied to the r.f. generator 32, the gas contained between the electrodes 20 and 22 is ionized and a plasma is generated in regions 24–26, allowing a visible, conical plume 28 to flow into the high vacuum region 30. To provide plasma to the high vacuum environment, the discharge must occur close to the plasma tube exit 26 as well as in region 24. If the discharge occurs only in region 24, then the plasma is attenuated by wall collision effects before reaching the plasma tube exit.

The production of the plasma plume 28 requires a proper combination of inner tube diameter, gas flow rate, radio frequency electrode geometry, radio frequency and input power. Although the exact values are not crucial, it has been found that a very good plume of cold plasma can be produced using a 4 mm inner diameter tube 16 at gas flow rates of 0.05–5.0 STD cc/minute. The spacing between the electrodes 52 and 22 can be varied from 2–5 cm, and the spacing between r.f. electrode 22 and the end 38 of the shield tube 18 can be varied between 0 and 3 cm. It was also found that the r.f. frequency can be varied between 50 and 200 MHz with the r.f. power input kept below 50 watts. Electrodes 52 and 22 are adjustably mounted upon the hollow conduit 16 for facilitating the production of an optimum performance.

While this device has been described with particular reference to the figures, it should not be construed to be limited to exactly to what is shown in these drawings or described in the specification. It will be obvious for those who possess ordinary skill in the art to make changes and modifications to this device without departing from the scope of the invention.

What is claimed is:

1. A method for cleaning contaminated surfaces in a high vacuum environment using a cold plasma discharge apparatus having an outer shield separating the interior of the discharge apparatus from the high vacuum environment, said method comprising the steps of:

introducing an ionizable gas into a conduit disposed within the outer shield of the plasma discharge apparatus, said conduit partially encircled by two radio frequency electrodes;

generating a radio frequency field within the conduit thereby ionizing the gas contained therein to create a cold plasma within said conduit between said first and second electrodes as well as between a non-constrictive nozzle and said second electrode;

ejecting the plasma at a low flow rate from the plasma discharge apparatus through said non-constrictive nozzle and aperture into the high vacuum environment while directing the plasma toward the contaminated surface.

2. A plasma cleaning device for cleaning contaminated surfaces present in a high vacuum environment comprising:

a substantially hollow housing member having an outer wall, and an end wall containing an aperture, said outer and end walls separating a higher pressure region within the interior of said housing from the high vacuum environment outside of said housing;

a hollow conduit, having an admitting end section and an emitting end section disposed within said housing member;

supply means connected to the admitting end section of said conduit for supplying highly ionizable gas therethrough;

first and second electrodes, each electrode partially encircling said conduit, said first electrode intermediate of said gas supply means and said second electrode;

a non-constrictive nozzle connected to the emitting end section of said conduit and disposed adjacent to said aperture; and a radio frequency generator connected to said first and second electrodes generating a cold plasma between said electrodes as well as between said second electrode and said non-constrictive nozzle, said plasma flowing into the high vacuum environment through said non-constrictive nozzle means and said aperture.

3. A plasma cleaning device in accordance with claim 2 wherein said first and second electrodes are adjustably mounted upon said hollow circuit.

4. A plasma cleaning device in accordance with claim 2 where said nozzle means, the section of said conduit between said first electrode and said end wall, and said aperture all have the same cross-sectional area.

5. A plasma cleaning device in accordance with claim 4 wherein said first electrode is a ground electrode and said second electrode is an r.f. electrode.

6. A plasma cleaning device in accordance with claim 5 wherein the spacing between said first and second electrodes is in the range of 2–5 cm, the spacing between said second electrode and the end wall of said housing member is in the range of 0–3 cm, the gas flow rate in the range of 0.05–5.0 STD cc/minute, the r.f. frequency is in the range of 50–200 MHz, and said conduit has an inner diameter of 4 mm.

7. A plasma cleaning device in accordance with claim 6 wherein the power of same radio frequency generator is less than 50 watts.

* * * * *